US005831549A

United States Patent [19]

Gearhart

[11] Patent Number: 5,831,549

[45] Date of Patent: Nov. 3, 1998

[54] TELEMETRY SYSTEM INVOLVING GIGAHERTZ TRANSMISSION IN A GAS FILLED TUBULAR WAVEGUIDE

[76] Inventor: Marvin Gearhart, P.O. Box 40540, Forth Worth, Tex. 76140

[21] Appl. No.: 864,011

[22] Filed: May 27, 1997

[51] Int. Cl.[6] ..... G01V 3/00

[52] U.S. Cl. ..... 340/853.1; 73/152.03

[58] Field of Search ..... 340/853.1, 854.4, 340/854.6, 870.28; 73/152.03

[56] References Cited

U.S. PATENT DOCUMENTS

| | | | |
|---|---|---|---|
| 3,905,010 | 9/1975 | Fitzpatrick | 340/854.4 |
| 4,066,994 | 1/1978 | Patchett | 367/81 |
| 4,814,768 | 3/1989 | Chang | 342/22 |

FOREIGN PATENT DOCUMENTS 2301851 12/1996 United Kingdom .

OTHER PUBLICATIONS

Low–Loss Waveguide Transmission, S.E. Miller, Member, Ire And A. C. Beck, Senior Member, Ire, Proc., I.R.E., Mar., 1951 pp. 348–358.

Recent Progress In Circular High–Power Overmoded Waveguide, William A. Hunting, Jeffery W. Warren and Jerry A. Krill, John Hopkins APL Technical Digest, vol. 12, Nov. 1, 1991, pp. 60–74.

Millimeter Wave Engineering And Applications, P. Bhartia and I. J. Bahl, , A Wiley–Interscience publication, 1984, pp. 186–264.

Waveguide as a Communiation Medium, S. E. Miller, The Cell System Technical Journal, vol. 33, No. 6, Nov., 1954, pp. 1209–1265.

IEEE Transactions On Microwave Theory And Techniques, Sep., p. 19.

*Primary Examiner*—Michael Horabik
*Assistant Examiner*—Albert K. Wong
*Attorney, Agent, or Firm*—Gunn & Associates P.C.

[57] ABSTRACT

This disclosure sets forth an electromagnetic measurement-while-drilling telemetry system, and more particularly, a telemetry system which utilizes a gas filled, metallic, tubular wave guide as a conduit between a downhole transmitter element and a surface receiver element. The tubular wave guide is positioned preferably concentrically within a drill string such as coiled tubing or conventional, rigid drill pipe. A valving system allows the tubular wave guide to be filled with gas, while the annulus between the inner conduit and the drill string is filled with drilling fluid. The preferred transmission frequency in the 20 to 40 gigaHertz range using a transverse electrical-circular pattern ($TEO_{0.1}$) wave transmission mode. Data transmission rates using the disclosed system are much greater that those obtained with mud pulsing systems, and attenuation rates are much lower than those obtained with electromagnetic systems using liquid filled wave guides.

24 Claims, 2 Drawing Sheets

TELEMETRY SYSTEM INVOLVING GIGAHERTZ TRANSMISSION IN A GAS FILLED TUBULAR WAVEGUIDE

BACKGROUND OF THE INVENTION

This invention is directed toward an electromagnetic telemetry system, and more particularly toward a telemetry system which utilizes a gas filled, metallic, tubular wave guide as a conduit between the transmitter and receiver elements of the transmission system. The preferred transmission frequency in the 20 to 40 gigaHertz range using a transverse electrical-circular pattern ($TE_{0.1}$) wave transmission mode in a drill pipe.

BACKGROUND OF THE ART

Telemetry is a key element in any communication system. Simply stated, the design criteria for most telemetry systems are (a) the maximization of the amount of information or "data" that can be transmitted per unit time between the transmitter element and the receiver element, and (b) the minimization of the transmitted data signal thereby minimizing power requirements for the transmitter and/or receiver elements of the system. There are, of course, other design criteria depending upon the particular application of the system, cost constraints, physical size constraints and the like. Nevertheless, the maximization of transmission rates and the minimization of attenuation are still primary goals within the framework of other such design constraints that may be imposed upon the system.

Almost any type of communication, control, and sensor system uses some form of telemetry. Amplitude and frequency modulation of electromagnetic carrier radiation are the backbone of the communications industry. Numerous wireless and "hard wired" systems are used as telemetry links between devices such as remote control devices for door or gate openers and the control station from which control commands are instigated. Likewise, numerous wireless and hard wired telemetry systems are used to couple remote sensors such as pressure, temperature, electromagnetic, acoustic and nuclear sensing devices to equipment which controls the operation of these sensors, and which also converts the basic responses of these sensors into parameters of interest such as pressure in pounds per square inch, temperature in degrees centigrade, phase shift and amplitude attenuation of induced magnetic radiation, and the like. Although almost endless in design and application, most telemetry systems share three basic elements which are a modulator element, a demodulator element, and a telemetry link connecting the modulator and demodulator elements. The modulator converts the response of a sensor, or the output of a microphone, or the output of a television camera to some type of signal or data that can be transmitted over the telemetry communication link. The demodulator element receives the transmitted data and converts these data to the desired output which might be spoken words, or a video image, or a set of measurements in engineering units. The telemetry link can be an electromagnetic or possibly an acoustic "wireless" link, or a "hard wired" link such as one or more electrical conductors, or one or more optical fibers.

Attention is now directed toward present systems used to telemeter between sensors or detectors located within a borehole and receivers and processing means located at the surface of the earth. Responses of sensors to geophysical parameters of earth formations penetrated by a borehole have traditionally been telemetered to the surface of the earth by "hard wired" cables or "wirelines" which contain electrical and possibly fiber optic conductors. These wirelines serve other purposes such as to support and to convey the sensors within the borehole. More recently, borehole geophysical measurements have been made during the actual drilling of the borehole. The traditional method of telemetry between sensors in the vicinity of the drill bit and the surface of the earth has been the well known drilling fluid or "mud" pulsing technique wherein data from the downhole sensors are conveyed to the surface of the earth by a series of pressure pulses transmitted through the drilling fluid column. Although the sophistication of these "measurement-while-drilling" or "MWD" sensors now approach that of their wireline counterparts, data rates of current mud pulsing systems are orders of magnitudes smaller than data transmission rates of wireline systems. Since it is not practical to employ a wireline effectively in a rotating drill string, it is generally surmised in the art that low data rate telemetry is the primary limiting factor in the advancement of the MWD art.

Various techniques have been used in an attempt to increase telemetry rates of MWD systems. In the 1980's, various electromagnetic telemetry techniques were employed between downhole sensors and the surface of the earth using the intervening earth formation as a conductor. Relatively low frequencies were required to penetrate depths encountered in oil and gas well drilling, especially in the presence of relatively conductive intervening formation (such as salt water saturated sands) which are so often encountered in hydrocarbon producing regions. Low frequencies resulted in very low data transmission rated, and attenuation of the transmitted signal still limited measurable transmissions to approximately 10,000 feet or less. Higher transmitting frequencies were used in an attempt to increase the data transmission capacity. Increasing the frequency, however, increased signal attenuation even more making transmissions over depths normally encountered in oil and gas well drilling essentially impractical, even when the intervening earth formation was relatively resistive. Such transmission systems have not enjoyed a wide spread commercial success.

Various systems have been introduced which use the metallic drill string as an acoustic telemetry link between sensors in the vicinity of the drill bit and recorders at the surface of the earth. Acoustic noise generated by the action of the drill bit penetrating or "cutting" the formation, along with additional noise generated by the scraping of the drill string against the borehole wall produces a noise level which essentially masks the acoustic telemetry signal. In addition, joints or collars in the drill string severely attenuate the acoustic signal. In summary, acoustic transmission systems have not been technical or commercially successful.

U.S. Pat. No. 3,905,010 to John Douglas Fitzpatrick teaches the use of a liquid filled, well bore tubular as a wave guide for microwave transmission between downhole pressure and temperature sensors for receiving and data processing means at the surface of the earth. Although the data transmission rates obtainable from this system are substantially greater than those obtainable from the previously mentioned mud pulsing system, signal attenuation is a major problem in the liquid filled circular wave guide.

In summary, prior art does not teach a method of maximizing previously mention telemetry design criterion for systems in which the borehole sensors and the surface processing means can not be connected by a "hard wired" telemetry conduit. Prior art systems with relatively high data transmission rates suffer from excessive signal attenuation, while those systems which exhibit acceptable signal attenuation properties suffer from very low data transmission rates.

SUMMARY OF THE INVENTION

This invention is directed toward an electromagnetic telemetry system, and more particularly toward a measurement-while-drilling telemetry system which utilizes a gas filled, metallic, tubular wave guide as a conduit between the transmitter and receiver elements of the transmission system.

One objective of the invention is to provide a telemetry link with a relatively high data transmission rate such that responses from currently available downhole sensor scan effectively be telemetered to the surface for processing and analysis. Another objective of the invention is to provide a data transmission system in which attenuation is minimized thereby minimizing power requirements for the transmission system. There or other objectives and advantages of the invention that will become apparent in the following disclosure.

The majority of oil and gas wells are drilled with circulating drilling fluid systems. Drilling fluid or "mud" is pumped from a reservoir at the surface of the earth, down through the hollow drill string such that it exits the drill string at the drill bit and returns to the surface by way of the annulus between the borehole and the drill string. The drilling mud serves several functions which are to maintain hydrostatic pressure within the borehole so that the internal pressure of formations penetrated by the bit is controlled, to provide a means of removing cuttings from the borehole and conveying these cuttings to the surface of the earth, to cool the drill bit, and to lubricate the drill bit. The mud column does, however, tend to decrease the rate of penetration of the drill bit thereby increasing the costs in drilling rig time and other expenses to drill the well to the desired depth. In addition, when borehole hydrostatic pressure exceeds that of the formation, the drilling fluid tends to "invade" the penetrated formation. Such invasion can cause subsequent problems in recovering or "producing" fluids from the formation.

Attempts have been made to maximize drilling rates, when other factors permit, by "air" drilling. Air drilling is a process which involves the circulation of air through the string of drill pipe. Air drilling has met with modest success. It is perhaps most successful in stone quarries, shallow oil and gas wells, and the like. Air is pumped down the string of drill pipe and out through the drill bit. The air is less effective than drilling mud in maintaining bottom hole pressure, but it enables an increase in the rate of penetration. Cuttings made by the drill bit are blown away by the air, but they are not as efficiently transported through the annular space between the drill string and the borehole wall as with mud circulation In addition, air does not provide the pressure balancing, lubricating and cooling functions as does circulating mud. Cooling has, at least in part, been dealt with by adding water mist to high pressure air pumped into an air drilling rig thereby providing some bit cooling from the water. In addition, the water mist tends to wet the dust which is formed by the drilling and enables an improved return rate with some reduction in dust.

Drilling systems have been investigated which utilizes both gas and drilling mud application Ser. No. 08/864,012 filed on May 27, 1997 discloses such a system and is hereby entered in this disclosure by reference. This enables the system to obtain the benefits of both air and mud drilling while yet maintaining safety by providing a continuous column of drilling mud in the annular space between the borehole and the drill string. The mud density is adjusted to drill normally at an "underbalanced" state wherein the pressure within the penetrated formation is somewhat less than the hydrostatic pressure within the borehole. The greater the underbalanced state, the greater the penetration rate of the drill bit. When formation pressure related difficulties are encountered, the weight of the drilling mud can be changed rapidly using the apparatus disclosed in the referenced application. This change is implemented by first measuring mud column density and the pressure at the bottom of the well. These measurements are then used to control a mixing valve. Drilling is conducted using a dual, essentially concentric drill string. The outer string is typically a string of drill pipe that is assembled as the well is drilled to greater depths, and that delivers a flow of drilling mud. On the interior of this string, a second or inner tubing string delivers air under pressure. Air is supplied from a compressor at the surface to the inner tubing string. This spaghetti tubing delivers air which is mixed with flowing mud by a mixing valve. This dilutes the drilling mud by adding the air, thereby reducing the effective density of the mud column. This enables the system to operate at an underbalanced pressure at the bottom of the well so that the rate of drilling can be increased. The air is switched on or off as needed to change the density of the mud and hence the balance of the column of mud acting against the formation that is being drilled. Moreover, gas flow can be switched off for safety sake thereby maximizing the density of the mud column. The mixing valve is ideally located so that an automatic decision to close the valve and thereby turn off the air flow immediately raises the density of the mud in the annular space, and increases bottom hole pressure.

The gas/drilling mud system also provides an ideally located element for an air filled, tubular wave guide for a microwave telemetry link between sensors within a drill collar in the vicinity of the drill bit and recording, processing and analysis means at the surface of the earth. This element is the inner tubular or inner conduit of the dual drill string, through which gas such as air or even nitrogen is pumped. The drill collar contains a transmitter and a source of power for the transmitter, as well as downhole sensors and associated control circuitry. The transmitter is operated preferably in the frequency range of 20 to 40 gigaHertz. This provides a usable band width which is considerably greater than the previously described mud pulse system. The system can easily telemeter words comprising 12 bits at an approximate rate of 25 words per second. This data telemetry rate is notably higher than current mud pulse telemetry systems. Electromagnetic radiation is transmitted using a transverse electrical-circular pattern ($TE_{0,1}$) wave transmission mode. This transmission mode is unique in that attenuation decreases as the transmission frequency increases. This is contrary to most other electromagnetic transmissions wherein attenuation increases as the frequency of transmission increases. Transmitter power requirements are thereby minimized which is an especially important feature in MWD systems. The responses of the sensors within the drill collar are used to modulate this "carrier" signal which, in turn, is transmitted by means of the gas filled inner tubing to the surface where it is demodulated, and the corresponding sensor responses are converted to parameters of interest such as pressure, temperature and the like.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting, of its scope, for the invention may admit to other equally effective embodiments.

DETAILED DESCRIPTION OF THE PREFERRED EMBODIMENT

Figure 1:
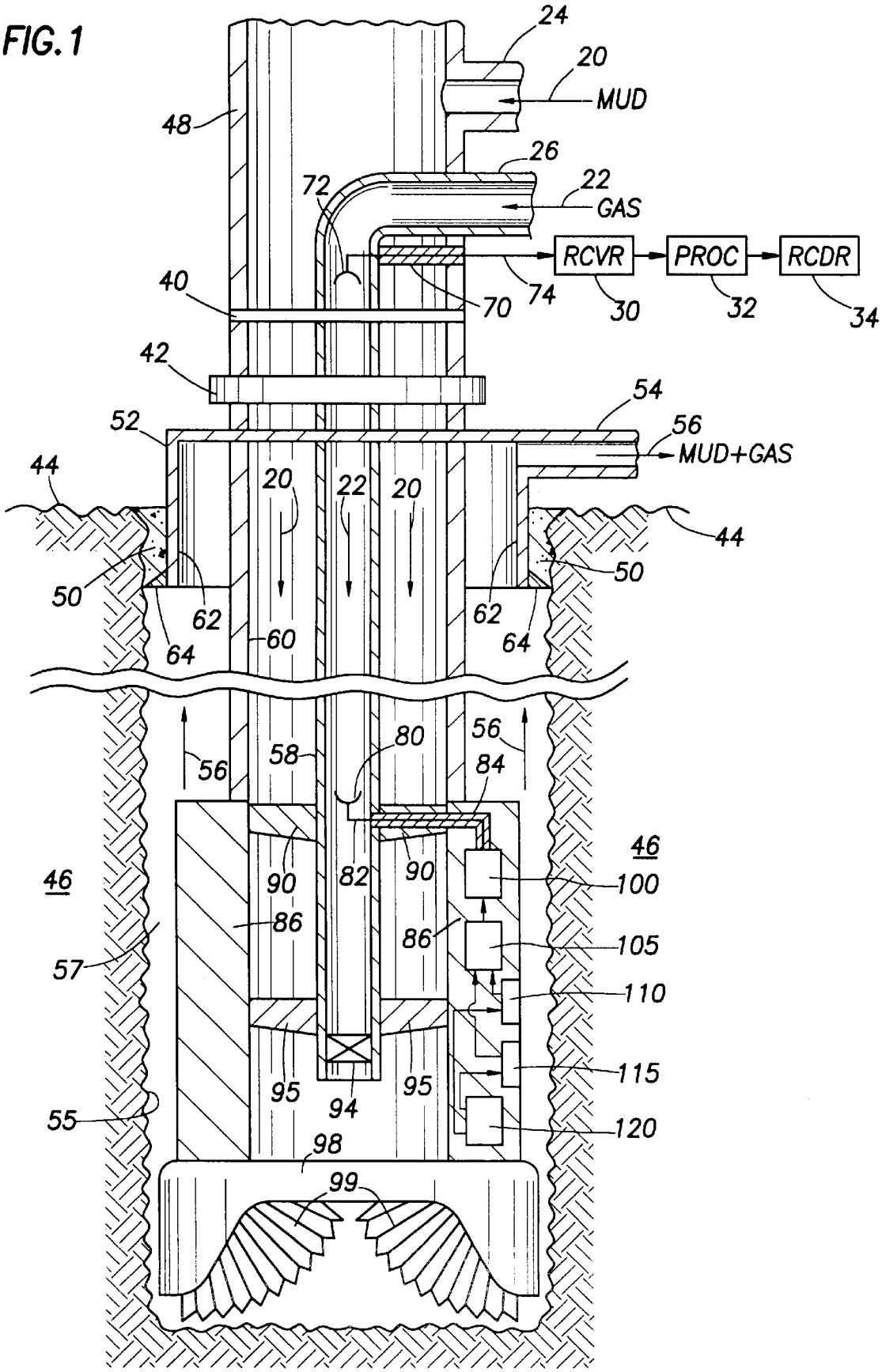
FIG. 1 is a conceptual illustration of a drilling system employing a drill string comprising concentric tubulars, and the use of the inner, gas filled tubular as a waveguide telemetry link between downhole sensors and a transmitter, and a surface receiver and processor.

FIG. 1 is a conceptual drawing of a borehole drilling apparatus which incorporates the elements of the invention and serves as a means for presenting an overview of the invention. The outer drill string is a metallic tubular 60 which terminates at an upper end at a swivel joint 40 and terminates at the second or lower end at a drill collar 86 which, in turn, is attached to a drill bit 98 comprised of three typical drill cones 99. As is well known in the art, the drill string 60 is made up of a series of tubular members or "joints" which are threaded together as the drill bit extends the depth of the borehole 57 which penetrates the earth formation designated by the numeral 46. The one or more drill collars 86 serve several functions well known in the art including the function of applying weight to the drill bit 98 to increase the penetration per revolution. The drill string 60 and drill bit 98 are rotated by rotating a Kelly 42 which is driven by a suitable power source (not shown) which is located at the surface 44 of the earth. The entire drill string is suspended within a borehole 57 by a crown assembly 48 which is conveyed vertically within a derrick (not shown) by a crown block (not shown) as the borehole 57 is extended or deepened by the drilling operation.

Still referring to FIG. 1, drilling fluid or drilling "mud", whose flow is denoted by the arrow 20, is pumped into the top of the drill stem assembly 48 through an inlet 24. The mud flow proceeds through the top drill stem assembly 48, which connects to the drill string 60 at the swivel joint 40, and subsequently flows downward inside of the drill string 60. The mud, whose flow direction is again denoted by the arrows 20, is then discharged through the drill bit 98 thereby performing functions previously discussed and well known in the art. The return mud flow, now denoted by the arrow 56, returns to the surface of the earth 44 by flowing in the annulus between the outer wall of the drill string 60 and the wall 55 of the borehole 57. This return flow of mud enters a surface casing 62 which hydraulically seals the borehole from the adjacent formations by means of the cylindrical cement sheath 50 and casing shoe 64. The mud then exits the surface casing through an output 54. Cuttings from the drill bit are removed from the returned mud, and the mud is again circulated through the drill string.

As shown in FIG. 1, the drill string contains a second or inner tubular string 58 with the first or top end terminating at the swivel joint 40 and the second or lower end terminating at a valve 94. The first end of the tubular 58 connects through the swivel joint 40 to a second inlet 26 in the crown assembly 48. The second end of the tubular 58 is preferably centered by means of stand-off "spiders" 90 and 95, through which fluid can pass, within the drill collar 86. Gas is pumped into the inlet 26 and flows, as indicated by the arrows 22, through the crown assembly 48 and downward through the inner tubular 58 to a valve 94. The valve controls the amount of gas which commingles with the flowing drilling mud. This commingled gas returns to the surface 44 of the earth as does the drilling mud, by way of the annulus 57 between the drill string 48 and the borehole wall 55.

Still referring to FIG. 1, one or more sensors are mounted within the wall of the collar 86. The sensors are used to measure temperature and pressure in the vicinity of the drill bit 98, with these measurements being used to control the opening of the valve 94, and therefore the weight of the column of drilling fluid, by adjusting the gas/liquid mix of the drilling fluid. The sensors can alternately be used to measure properties of the formation 46 that is penetrated by the cutting action of the cones 99 of the drill bit 98, or additional sensors can be added to perform both mud column and formation properties measurements. For purposes of discussion, two sensors denoted by the numerals 110 and 115 are illustrated. The wall of the drill collar 86 also supports control circuits 105 which control the operation of the sensors 115 and 110 and also condition the signal output of these sensors so that the outputs are compatible with the input of a transmitter denoted by the numeral 100. The drill collar 86 also supports a power supply 120 which supplies power to the sensors 110 and 115 as denoted by the functional diagram paths. The power supply 120 also supplies power to the control circuits 105 and the transmitter 100, although the functional diagram paths have been omitted from FIG. 1 for purposes of clarity. A transmitter antenna 82 is mounted preferably concentrically within the inner tubular 58. The antenna is electrically connected to the transmitter 100 by an electrical lead 82 which preferably passes through one arm of the spider standoff 90, within an insulating coaxial sleeve 84, to the output of the transmitter 100. Signals encoding the output of the sensors 110 and 115 are transmitted, using the gas filled inner tubular 58 as a wave guide, to a receiving antenna 72 which is preferably mounted within the crown assembly 48. The receiving antenna 72 is electrically connected to a receiving circuit by means of an electrical lead 74, preferably passing through the wall of the crown assembly 48 along a coaxial insulator 70. The output of the receiver 30 is processed within a processor 32 wherein received signals are converted to the corresponding responses of the sensors 110 and 115, preferably in engineering units such as pressure in pounds per square inch, temperature in degrees centigrade, or the like. The sensors are then recorded for subsequent use by a recorder 34 which may be a magnetic recorder, an optical disk recorder, or alternately a "hard copy" recording device such as a chart recorder.

Attention is now directed toward the transmission of electromagnetic radiation within a circular waveguide and in particular, an attenuation of the various modes. For a hollow, circular, air filled, copper, tube waveguide, the attenuation coefficients $a_c$ in units of decibels per foot (db/ft) for the $TE_{1,1}$ (dominant mode), $TM_{0,1}$ (circular magnetic mode) and $TE_{0,1}$ (circular electric mode) are given by the equations (1), (2) and (3), respectively, as $$a_c=(0.00423(f/f_c)^{-1/2}+0.420(f/fc)^{3/2})/((f/fc)^2-1)^{1/2} \quad (1)$$

$$a_c=(0.00485(f/f_c)^{3/2})/((f/fc)^2-1)^{1/2} \quad (2)$$

and $$a_c=(0.00611(f/f_c)^{-1/2})/((f/fc)^2-1)^{1/2} \quad (3)$$

where a=the radius of the waveguide (inches);

f=the frequency of the transmitted wave; and $f_c$=the cutoff frequency

Figure 2:
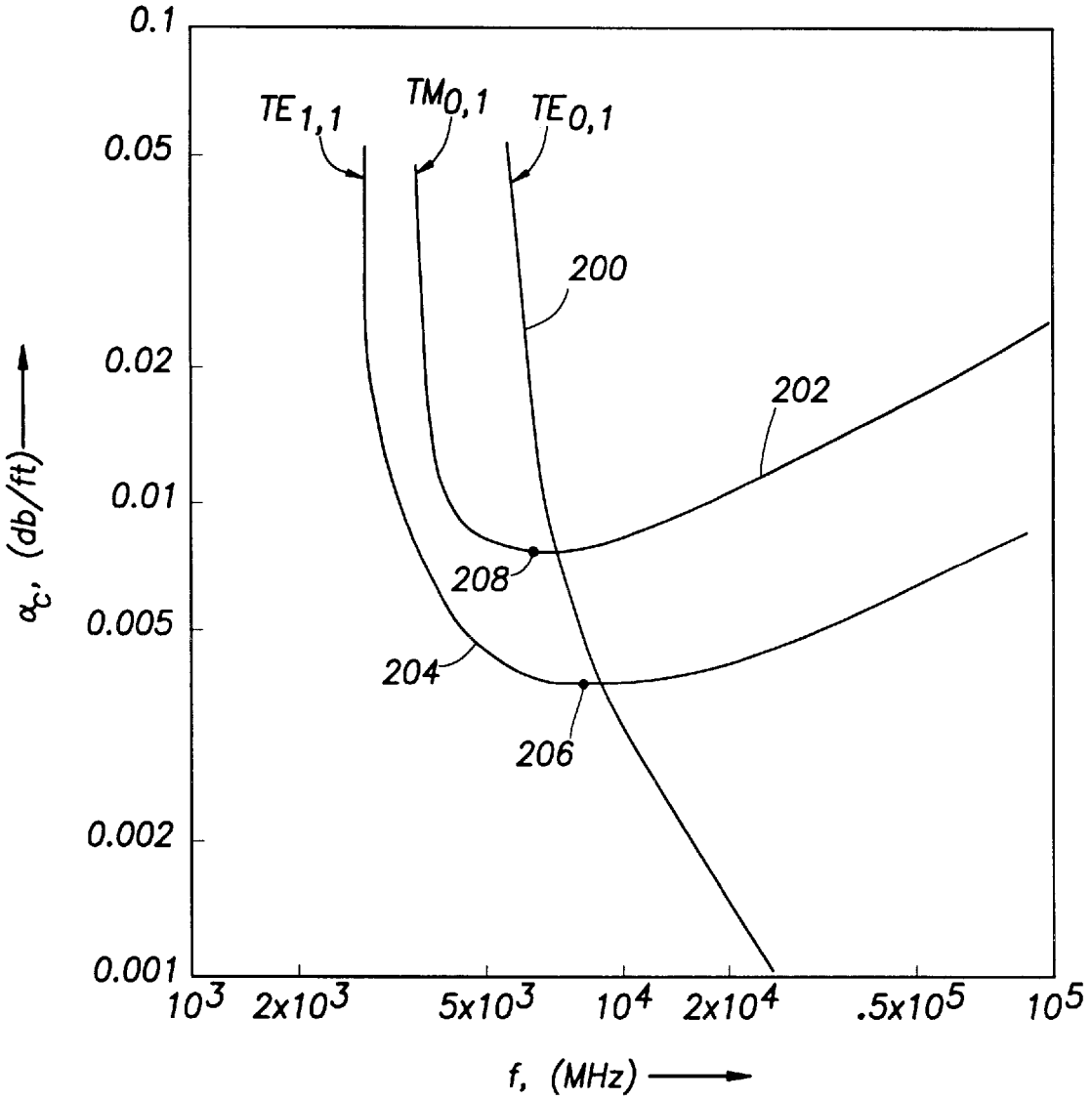
FIG. 2 shows the attenuation of electromagnetic radiation as a function of frequency for propagation in three modes within a circular, copper walled, air filled wave guide.

Plots of $a_c$ for the three modes represented by equations (1), (2) and (3), as a function of f, are shown in FIG. 2 for a copper wave guide which is 2.0 inches in diameter (i.e. a=1.0 inches) with the curves being designated by the numerals 204, 202 and 200, respectively. It should be noted that attenuation as a function of frequency is also a function of the waveguide material and the material within the hollow wave guide, as will be discussed is a following section. It should also be noted that the curves 202 and 204 for the $TM_{0,1}$ and $TE_{1,1}$ modes reach minima 208 and 206, respectively, for frequencies in the range of 10 gigaHertz (gHz). For higher frequencies, the attenuation of these modes increases. The behavior of the curve 200 representing the $TE_{0,1}$ behaves quite differently. Attenuation versus frequency for this mode does not reach a minima, but continues to decrease with frequency. This property of the $TE_{0,1}$ mode is, therefore, the mode of choice for microwave based telemetry systems to meet the system design criteria of (a) maximum frequency for maximization of data rates, and (b) minimization of signal attenuation for minimization of power requirements.

Referring again to FIG. 1, the inner tubular or conduit 58 of the drill string is preferably made of steel for mechanical strength purposes. The plot of attenuation versus frequency for the three transmission modes for a circular, 2.0 inch, air filled, circular wave guide will yield curves which differ from those shown for a copper waveguide shown in FIG. 2 and represented by the equations (1), (2) and (3). Specifically, the values of $a_c$ for a wave guide made of copper can be transformed into attenuation coefficients, $a'_c$, for a material made of another conductor by means of the relationship $$a'_c = Ka_c \tag{4}$$

where $K=(m_1(R_x/R_{Cu}))^{1/2}$ and $R_{Cu}$=the resistivity of copper;

$R_x$=the resistivity of the wave guide material "x"; and $m_1$=the permeability of the waveguide material "x"

For the preferred material of steel for the inner conduit 58, $m_1$=25 and $(R_x/R_{Cu})$=5.9 therefore, substituting these values into equation for K yields a value of K=12.2 for a steel wave guide conduit. Since K for steel is greater than 1, and assuming that the inner conduit 58 is of diameter 2.0 inches, attenuation at a given frequency for all modes will be greater than corresponding values shown in FIG. 1 for a copper waveguide conduit. The general behavior of the curves will, however, remain the same in that attenuation for the $TE_{0,1}$ mode will continue to decrease for increasing frequencies thereby making the normally gas filled inner conduit 58 an ideal telemetry link for microwave transmission in the $TE_{0,1}$ mode between the downhole sensors 110 and 115 and receiving means 30 and processing means 32 at the surface of the earth 44.

As mentioned previously, the attenuation properties $a_g$ of the material filling the inside of the wave guide also affects the overall attenuation of a signal transmitted by means of the circular waveguide. This effect can best be illustrated with examples. For purposes of illustration, assume a=1.0 inch, f=34 GHz, $f_c$=7.2 GHz, and that the waveguide is made of steel with $m_1$=25. These parameters closely match the preferred embodiment of the invention. Also assume that the wave guide, which is in fact the inner conduit 58, is filled with air at atmospheric pressure and the air contains 10 grams per cubic meter (Gm/m3) of water vapor. For this example $a_g$=0.0274 db/ft $K=(m_1(R_x/R_{Cu}))=12.2$ $a'_c=Ka_c=12.2*0.00058=0.0071$ db/ft The total attenuation coefficient a for the waveguide and the gas therein is $$a=a_g+a'_c=0.0071+0.0274=0.0345\ db/ft$$

Other values for $a_g$ for varying concentrations of moisture within air are, for comparison purposes, Rain at the rate of 5.0 centimeters per hour: $a_g$=0.00366 db/ft Fog with a visibility of 40 feet: $a_g$=0.00122 db/ft Fog with a visibility of 10 feet: $a_g$=0.00762 db/ft A complete treatment of the relationship between moisture content of air and the attenuation properties of air is treated in numerous sources in the literature. An excellent review of the subject is presented in "Millimeter Wave Engineering and Applications". P. Bhartia and I. J. Bahl, John Wiley and Sons, New York, pp. 187–263. More specific references include "Microwave Scattering Parameters of New England Rain", R. K. Crane, Tech. Rept. No. 426, Lincoln Laboratories, M. I. T., Massachusetts, October, 1996, and "Attenuation and Depolarization of Rain and Ice Along Inclined Paths Through the Atmosphere at Frequencies at Above 10 GHz". IEEE EASCON-79 Rec., Vol. 1, 1979, pp. 156–162. Considering the air compressor unit (not shown) used to supply air to the inner conduit 58 in the preferred embodiment of the invention, it is estimated that $a_g$ will more closely match atmospheric fog with a visibility of 10 feet, or $a_g$=0.00762 db/ft. For this example $$a=a_g+a'_c=0.0071+0.00762=0.0147\ db/ft$$

Using currently available power sources 120 to supply the transmitter 100, an attenuation of 150 db can be effectively tolerated at the receiver 30. Therefore, for the example above, wherein $a_g$=0.00762 db/ft (which is thought to be representative of the operating parameters of the invention), data can be transmitted at 34 GHz in the $TE_{0,1}$ mode by means of a 2.0 inside diameter steel waveguide conduit over a distance of 150 db/0.0147 db/ft=10,260 feet. Details of a representative waveguide design, transmitter and receiver design and telemetry schemes are summarized in a publication by S. E. Miller (S. E. Miller, "Waveguide as a Communication Medium", The Bell System Technical Journal. Vol. XXXIII, No. 10, November, 1954).

Features of the present invention will now be compared to features of the system taught in the previously referenced U.S. Pat. No. 3,905,010 to John Douglas Fitzpatrick (Fitzpatrick). The Fitzpatrick system transmits in the $TE_{1.1}$ mode with an optimum transmission frequency of $$f=2c/3d$$

where c=the velocity of light in the medium within the circular waveguide;

d=the diameter of the waveguide; and $c=c_0/N$, and where $c_0$=the velocity of light in a vacuum; and N=the index of refraction of the medium within the waveguide.

It is noted that in the applications for telemetry system taught by Fitzpatrick, no specific methodology is taught for removing liquid from the tubing. Furthermore, the example set forth by Fitzpatrick assumes that the tubing is filled with benzene. As a result, the use of the tubing as a waveguide by Fitzpatrick must assume that the waveguide may be filled with liquid. With this in mind, the following calculation, which is set forth as an example presented in the Fitzpatrick reference, is presented here as a comparison with the present invention. Using the Fitzpatrick system with d=2 inches (5.08 cm) and with the medium within the waveguide as benzene with an index of refraction N=1.5, then $c=c_0/N=3*10^{10}/1.5=2*10^{10}$ cm/second and f=2.63 GHz. The total attenuation $a=a_g+a'_c$ for $TE_{1,1}$ transmission at 2.63 GHz is now computed for the benzene filled, copper waveguide as $a=a_g+a'c=0.1$. For purposes of comparison, this attenuation value is converted to the corresponding value of attenuation within a steel waveguide of the same dimensions again using $$K=(m_1(R_x/R_{Cu}))=12.2;$$

and $$a'_c=Ka_c=12.2*0.01=0.12 \text{ db/ft}$$

For a total attenuation of 150 db using, the optimum transmission frequency of the Fitzpatrick system of 2.63 GHz, data can be transmitted in the $TE_{1,1}$ mode by means of a 2.0 inside diameter steel waveguide over a distance of 150 db/0.12 db/ft=1,250 feet. This compares with a transmission distance of 10,260 feet from the example using the present invention, wherein the steel inner conduit waveguide of the present invention is filled with "moist" air equivalent to fog at atmospheric pressure and a visibility of 10 feet. Referring to the curve 204 in FIG. 2, it is apparent that if the frequency of transmission of the Fitzpatrick system were either increased or decreased substantially, then attenuation would be even greater (and the transmission distance for a total loss of 150 db would be even shorter) than the values computed with the example parameters.

Based upon the previous examples comparing the present invention to the system of Fitzpatrick, it is apparent that telemetry loss of the Fitzpatrick system is much greater than that of the present system. In addition, the telemetry transmission frequency of the present invention is much higher than the transmission frequency of the Fitzpatrick system. This is because the drill string of the present invention incorporates an essentially gas filled inner conduit as a waveguide for $TE_{0,1}$ modal transmission at a higher frequency. Using any of several carrier frequency modulation techniques exemplified in the previously referenced publication by Miller, transmission frequencies of 20 to 40 GHz easily send 12 bit words telemetered at a rate of approximately 25 words per second.

A repeater station, having the form of an inner tubular sub with a passage of the common diameter (two inches in the common or exemplary size) can readily support a thick wall sub with similar recesses protecting a transmitter, receiver and connected power supply. By installing an antenna (actually one for receiving and one for sending), a slave or repeater can be located in the tubing string and the signal can be boosted for longer distance transfer.

While the foregoing is directed to the preferred embodiment of the invention, the scope thereof is determined by the claims which follow.

What is claimed is:

1. A borehole telemetry system comprising:

(a) a transmitter located within a borehole;

(b) a receiver located up the borehole from said transmitter for receiving transmissions from said transmitter; and (c) a rotatable, circular, gas filled conduit positioned within a rotatable outer conduit and connecting said transmitter and receiver, wherein (d) said transmitter transmits a transverse electrical-circular pattern within said conduit.

2. The system of claim 1 wherein;

(a) said transmitter is mounted by a drill collar affixed to a lower end of said gas filled conduit and in the vicinity of a drill bit;

(b) said receiver is at an upper end of said gas filled conduit at the surface of the earth; and (c) said borehole and said outer conduit are filled with liquid outside said gas filled conduit.

3. The system of claim 2 wherein said transmitter transmits a signal indicative of a response of a sensor mounted within said drill collar while said gas filled conduit and said outer conduit are rotating.

4. The system of claim 3 wherein said sensor responds to a property of earth formation penetrated by said drill bit.

5. The system of claim 3 wherein said sensor responds to a property of material within said borehole in the vicinity of said drill collar.

6. The system of claim 1 wherein said transmitter transmits at a frequency between about 20 to 40 gigaHertz.

7. A measurement while drilling system comprising:

(a) a drill collar comprising (i) a transmitter, and (ii) a sensor;

(b) a drill string with a lower end connected to said drill collar, wherein (i) said drill string comprises rotatable outer conduit and a rotatable, concentric, circular inner conduit, and (ii) said inner conduit is filled with gas;

(c) a receiver connected to an upper end of said drill string at the surface of the earth to receive transmissions from said transmitter; and (d) said transmitter transmits a signal indicative of the response of said sensor.

8. The system of claim 7 further comprising a processor for converting said signal into a measure of a physical property of material in the vicinity of said sensor.

9. The system of claim 7 wherein said transmitter transmits a transverse electrical circular pattern at a frequency between about 20 to 40 gigaHertz.

10. A method for telemetering a signal within a borehole, comprising:

(a) positioning a transmitter within a borehole;

(b) positioning a receiver up hole from said transmitter for receiving transmissions from said receiver; and (c) providing a rotatable drill string comprising (i) an outer conduit, and (ii) a circular, gas filled conduit positioned within said outer conduit and connecting said transmitter and receiver, and (d) transmitting along said gas filled conduit in a transverse electrical-circular pattern within said conduit.

11. The method of claim 10 further comprising;

(a) mounting said transmitter within a drill collar affixed to a lower end of said gas filled conduit and in the vicinity of a drill bit;

(b) extending said gas filled conduit from said drill collar to an upper end at the surface of the earth; and (c) locating said receiver to said upper end of said gas filled conduit, wherein said borehole is filled with liquid.

12. The method of claim 11 wherein said signal is indicative of a response of a sensor mounted within said drill collar.

13. The method of claim 12 wherein said sensor responds to a property of earth formation penetrated by said drill bit.

14. The method of claim 12 wherein said sensor responds to a property of material within said borehole in the vicinity of said drill collar.

15. The method of claim 10 wherein said transmitter transmits at a frequency between about 20 to 40 gigaHertz.

16. The method of claim 10 wherein said transmitter and receiver are at the extreme ends of said gas filled conduit.

17. The method of claim 10 wherein said transmitter is spaced along said gas filled conduit, and including the step of operating a second transmitter and receiver serially along said gas filled conduit to enable serial signal relay of data along said gas filled conduit.

18. The method of claim 17 including the step of transmitting said signal from said transmitter, receiving said signal with said second receiver, and transmitting said received signal with said second transmitter thereby relaying said signal along said gas filled conduit.

19. A borehole telemetry system comprising:

(a) a transmitter located within a borehole;

(b) a receiver located up the borehole from said transmitter for receiving transmissions from said transmitter; and (c) an operationally rotatable, circular, gas filled conduit connecting said transmitter and receiver, wherein (d) said transmitter transmits a transverse electrical-circular pattern within said conduit.

20. The system of claim 19 wherein;

(a) said transmitter is mounted by a drill collar affixed to a lower end of said conduit and in the vicinity of a drill bit;

(b) said receiver is at an upper end of said conduit at the surface of the earth; and (c) said borehole is filled with liquid outside said conduit.

21. The system of claim 20 wherein said transmitter transmits a signal indicative of a response of a sensor mounted within said drill collar.

22. The system of claim 21 wherein said sensor responds to a property of earth formation penetrated by said drill bit.

23. The system of claim 22 wherein said sensor responds to a property of material within said borehole in the vicinity of said drill collar.

24. The system of claim 19 wherein said transmitter transmits at a frequency between about 20 to 40 gigaHertz.

* * * * *